US010834968B2

(12) United States Patent
John et al.

(10) Patent No.: US 10,834,968 B2
(45) Date of Patent: Nov. 17, 2020

(54) APPARATUS FOR HEATING AEROSOL GENERATING MATERIAL

(71) Applicant: BRITISH AMERICAN TOBACCO (INVESTMENTS) LIMITED, London (GB)

(72) Inventors: Edward John, London (GB); Walid Aoun, London (GB); Bryan Allbutt, London (GB); David Robert Seaward, London (GB); David Phasey, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 554 days.

(21) Appl. No.: 15/547,028

(22) PCT Filed: Jan. 27, 2016

(86) PCT No.: PCT/EP2016/051727
§ 371 (c)(1),
(2) Date: Jul. 27, 2017

(87) PCT Pub. No.: WO2016/120344
PCT Pub. Date: Aug. 4, 2016

(65) Prior Publication Data

US 2018/0271153 A1 Sep. 27, 2018

(30) Foreign Application Priority Data

Jan. 28, 2015 (GB) ..... 1501429.3

(51) Int. Cl.
*A24F 47/00* (2020.01)
*A24B 15/167* (2020.01)

(52) U.S. Cl.
CPC ..... *A24F 47/008* (2013.01); *A24B 15/167* (2016.11)

(58) Field of Classification Search
CPC ..... A24F 47/008; A24F 47/004; A24F 15/00; A24F 15/005; A24F 15/01; A24F 15/015;
(Continued)

(56) References Cited

U.S. PATENT DOCUMENTS 5,479,948 A 1/1996 Counts
5,730,158 A 3/1998 Collins
(Continued)

FOREIGN PATENT DOCUMENTS

CA 2047823 2/1992
CN 1102964 5/1995
(Continued)

OTHER PUBLICATIONS

English Translation of Korean Office Action, Application No. 10-2019-7011902, dated May 9, 2019.
(Continued)

*Primary Examiner* — Jimmy Chou
(74) *Attorney, Agent, or Firm* — Patterson Thuente Pedersen, P.A.

(57) ABSTRACT

There is described an apparatus for heating an aerosol generating material to generate an inhalable aerosol and/or gas. The apparatus includes a housing; a receptacle within the housing, the receptacle including one or more cavities, each cavity for containing an aerosol generating material; and a heating arrangement including one or more heater elements for heating aerosol generating material contained in the one or more cavities to generate an inhalable aerosol and/or gas. The one or more heater elements are located externally of the one or more cavities.

23 Claims, 15 Drawing Sheets

(58) Field of Classification Search
CPC ..... A24F 15/02; A24F 15/04; A24F 15/12; A24F 15/14; A24F 15/16; A24F 15/18; A24F 15/20; A24F 17/00; A24F 7/00; A24F 11/00; A24F 13/00; A24D 3/0258; H05B 3/0014; A24B 15/167
USPC ..... 131/329, 347; 392/404
See application file for complete search history.

(56) References Cited

U.S. PATENT DOCUMENTS

| | | | | |
|---|---|---|---|---|
| 6,026,820 | A | 2/2000 | Baggett, Jr. | |
| 6,971,383 | B2 * | 12/2005 | Hickey | A61M 15/0085 128/203.12 |
| 7,377,277 | B2 * | 5/2008 | Hickey | A61M 15/0045 128/203.15 |
| 8,061,362 | B2 | 11/2011 | Mua et al. | |
| 8,881,737 | B2 | 11/2014 | Collett | |
| 2002/0078951 | A1 * | 6/2002 | Nichols | A61M 11/041 128/200.22 |
| 2005/0211698 | A1 * | 9/2005 | Kirkman | H05B 3/28 219/438 |
| 2011/0204038 | A1 * | 8/2011 | Feng | H05B 3/28 219/213 |
| 2012/0260927 | A1 | 10/2012 | Liu | |
| 2013/0180516 | A1 | 7/2013 | Damani et al. | |
| 2014/0000638 | A1 | 1/2014 | Sebastian | |
| 2014/0060554 | A1 * | 3/2014 | Collett | H05B 3/265 131/328 |
| 2014/0123989 | A1 | 5/2014 | LaMothe | |
| 2014/0305454 | A1 * | 10/2014 | Rinker | A24F 47/008 131/329 |
| 2014/0338680 | A1 * | 11/2014 | Abramov | A24F 47/008 131/328 |
| 2014/0360515 | A1 * | 12/2014 | Vasiliev | A24F 47/008 131/329 |
| 2014/0366898 | A1 | 12/2014 | Monsees | |
| 2015/0090256 | A1 * | 4/2015 | Chung | A61M 15/002 128/202.21 |
| 2016/0135505 | A1 * | 5/2016 | Li | H05B 3/44 131/329 |
| 2016/0138795 | A1 * | 5/2016 | Meinhart | F24F 6/025 392/395 |
| 2017/0108210 | A1 * | 4/2017 | Meinhart | F22B 1/30 |
| 2017/0318862 | A1 * | 11/2017 | Mironov | A24F 47/008 |
| 2017/0347712 | A1 | 12/2017 | Singh | |
| 2017/0347713 | A1 | 12/2017 | Robinson | |
| 2018/0015385 | A1 | 1/2018 | Meinhart et al. | |
| 2018/0042302 | A1 | 2/2018 | Robinson | |
| 2018/0070635 | A1 | 3/2018 | Litten | |
| 2019/0082734 | A1 * | 3/2019 | Alarcon | A24F 15/12 |

FOREIGN PATENT DOCUMENTS

| | | | |
|---|---|---|---|
| CN | 101518361 | | 9/2009 |
| CN | 103876288 | | 6/2014 |
| EP | 640297 | | 7/1994 |
| JP | 7147965 | | 6/1995 |
| JP | 2005516647 | | 6/2017 |
| KR | 10-2002-0086624 | | 11/2002 |
| WO | WO 168169 | | 9/2001 |
| WO | WO 3049792 | | 6/2003 |
| WO | WO 2014037794 | | 3/2012 |
| WO | WO 2013/034460 | | 3/2013 |
| WO | WO 2013152873 | | 10/2013 |
| WO | WO 2013160112 | | 10/2013 |
| WO | WO2014037794 | A2 | 3/2014 |
| WO | WO2014177693 | A1 | 11/2014 |
| WO | WO2014177696 | A1 | 11/2014 |

OTHER PUBLICATIONS

Canadian Office Action, Application No. 2,973,305, dated Feb. 26, 2019, 6 pages.
Chinese Office Action, Application No. 201680019503.0, dated Jul. 5, 2019, 24 pages.
International Search Report, International Application No. PCT/EP2016/051727, dated Jul. 25, 2016, 4 pages.
Australian Examination Report, Application No. 201612042, dated Jun. 29, 2018, 6 pages.
Japanese Office Action, Application No. 2017-539638, dated Aug. 14, 2018, 5 pages.
Korean Office Action, Application No. 10-2017-7023910, dated Aug. 30, 2018, 13 pages.

* cited by examiner

APPARATUS FOR HEATING AEROSOL GENERATING MATERIAL

CROSS-REFERENCE TO RELATED APPLICATIONS

The present application is a National Phase entry of PCT Application No. PCT/EP2016/051727, filed Jan. 27, 2016, which claims priority from GB Patent Application No. 1501429.3, filed Jan. 28, 2015, each of which is hereby fully incorporated herein by reference.

TECHNICAL FIELD

The present disclosure relates to apparatus arranged to heat aerosol generating material.

BACKGROUND

Smoking articles such as cigarettes, cigars and the like burn tobacco during use to create tobacco smoke. Attempts have been made to provide alternatives to these smoking articles by creating products that release compounds without actually combusting and hence which do not create smoke or an aerosol as a result of degradation of, for example, tobacco by combustion or the process of burning. Examples of such products are so-called heat-not-burn products, tobacco heating products or tobacco heating devices which release compounds, which may form an aerosol, by heating, but not burning, aerosol generating material. The aerosol generating material may be for example tobacco or other non-tobacco products, which may or may not contain nicotine.

SUMMARY

In accordance with some embodiments described herein, there is provided an apparatus for heating an aerosol generating material to generate an inhalable aerosol and/or gas, the apparatus comprising: a housing; a receptacle within the housing, the receptacle comprising one or more cavities, each cavity for containing an aerosol generating material; and a heating arrangement comprising one or more heater elements for heating aerosol generating material contained in the one or more cavities to generate an inhalable aerosol and/or gas, wherein the one or more heater elements are located externally of the one or more cavities.

The receptacle may comprise a plurality of cavities, each cavity for containing an aerosol generating material, and the heating arrangement may comprises a plurality of heater elements and wherein each heater element is arranged externally of a respective one of the plurality of cavities and is for heating aerosol generating material contained in that cavity to generate an inhalable aerosol and/or gas.

The apparatus may be arranged so that the receptacle is removeable from the housing so that it can be replaced with a replacement receptacle.

The receptacle may comprise a sheet and each of the one or more cavities may comprise a recess formed in the sheet.

The receptacle may comprise a sheet comprising a flat surface and a barrier layer covering at least a portion of the flat surface and wherein each of the one or more cavities is defined by a part of the barrier layer and a part of the flat surface covered by that part of the barrier layer.

The receptacle may comprise a flexible strip of material and the one or more cavities are at least partly defined by the strip.

The apparatus may further comprise a drive arrangement for moving the flexible strip to allow different cavities to be heated by the heating arrangement.

The drive arrangement may comprise a rotatably mounted spool around which part of the flexible strip is wound.

In accordance with some embodiments described herein, there is also provided an apparatus for heating an aerosol generating material to generate an inhalable aerosol and/or gas, the apparatus comprising: a housing; a receptacle within the housing, the receptacle comprising one or more cavities, each cavity for containing an aerosol generating material; and a heating arrangement comprising one or more heater elements for heating aerosol generating material contained in the one or more cavities to generate an inhalable aerosol and/or gas, wherein at least one cavity of the one or more cavities has a respective one of the one or more heater elements located therein, wherein the one heater element is a coil or mesh heater element.

In accordance with some embodiments described herein, there is provided a method of preparing a receptacle for an aerosol generating material, the method comprising: filling one or more cavities of the receptacle with a relatively wet aerosol generating material, the relatively wet aerosol generating material comprising a percentage of water; treating said relatively wet aerosol generating material to reduce the percentage of water of said relatively wet aerosol generating material to generate a relatively dry aerosol generating material in the one or more cavities.

BRIEF DESCRIPTION OF THE DRAWINGS

Embodiments of the disclosure will now be described, by way of example only, with reference to the accompanying drawings, in which.

DETAILED DESCRIPTION

As used herein, the term "aerosol generating material" includes materials that provide volatilized components upon heating. "Aerosol generating material" includes any tobacco-containing material and may, for example, include one or more of tobacco, tobacco derivatives including tobacco extracts, expanded tobacco, reconstituted tobacco or tobacco substitutes. "Aerosol generating material" also may include other, non-tobacco, products, including for example flavorants, which, depending on the product, may or may not contain nicotine, filler materials such as chalk and/or sorbent materials, glycerol, propylene glycol or triacetin. The aerosol generating material may also include a binding material, for example, sodium alginate.

Figure 1:
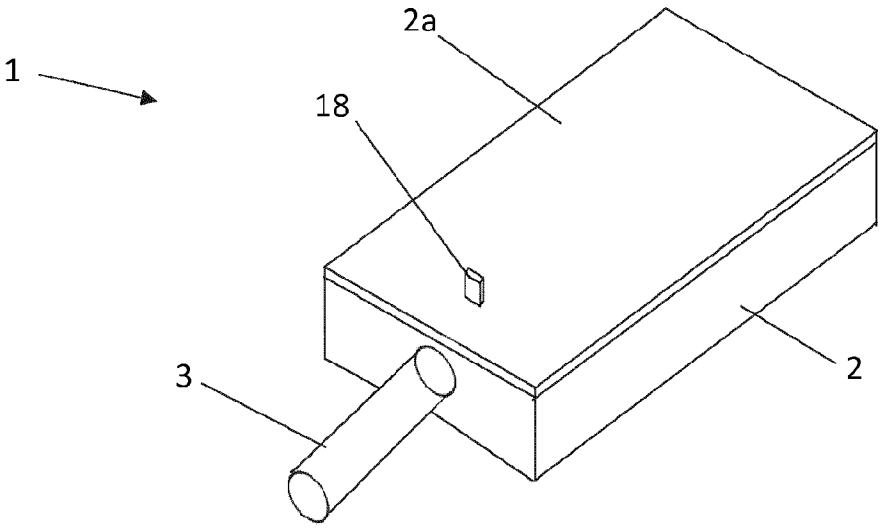
FIG. 1 shows a schematic perspective view of an example of an apparatus for heating an aerosol generating material.

Referring to FIG. 1, there is shown a perspective view of an example of an apparatus 1 arranged to heat aerosol generating material (not shown in FIG. 1) to volatize at least one component of the aerosol generating material. The apparatus 1 is a so-called "heat-not-burn" apparatus. The apparatus 1 in this example is generally elongate, having a generally cuboidal outer housing 2 of rectangular cross-section and comprising a lid 2*a*. The apparatus 1 may comprise any suitable material or materials, for example, the outer housing 2 may comprise plastic or metal. The apparatus 1 has a mouthpiece 3 through which a user can draw material that has been volatilized in the apparatus 1. The mouthpiece 3 (or at least the tip of the mouthpiece 3) may comprise a material that feels comfortable to the lips, for example, suitable plastics or silicone rubber based materials.

Figure 2:
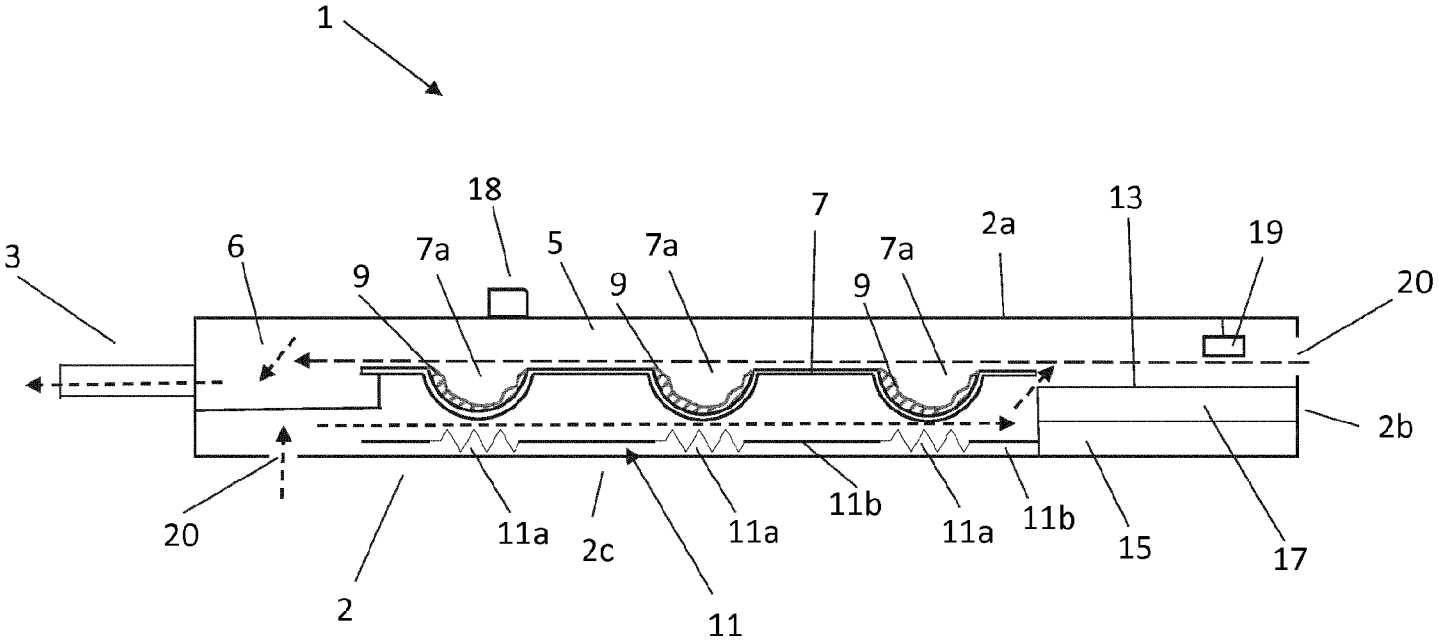
FIG. 2 shows a schematic cross-sectional side view of the apparatus of FIG. 1.

Referring particularly to the cross-sectional view of FIG. 2, the apparatus 1 has a heating chamber 5 which in use contains a receptacle 7 for containing the aerosol generating material 9 to be heated and volatilized. The heating chamber 5 is in fluid flow communication with the mouthpiece 3. The heating chamber 5 further contains a heater arrangement 11 for heating the aerosol generating material 9. An aerosol formation and condensation zone 6 may be provided between the heating chamber 5 and the mouthpiece 3 (or as part of the mouthpiece 3).

The apparatus 1 further has an electronics/power chamber 13 which in this example contains electrical control circuitry 15 and a power source 17. In this example, the heating chamber 5 and the electronics/power chamber 13 are adjacent each other along the longitudinal axis of the apparatus 1. The electrical control circuitry 15 may include a controller, such as a microprocessor arrangement, configured and arranged to control the heater arrangement 11 as discussed further below.

The power source 17 may be a battery, which may be a rechargeable battery or a non-rechargeable battery. Examples include nickel cadmium batteries although any suitable batteries may be used. The battery 17 is electrically coupled to the heater arrangement 11 (to be discussed further below) of the heating chamber 5 to supply electrical power when required and under control of the electrical control circuitry 15 to heat the aerosol generating material 9 (as discussed, to volatize the aerosol generating material 9 without causing the aerosol generating material 9 to combust or undergo pyrolysis).

The apparatus 1 may further comprise one or other or, as is illustrated in FIG. 2, both of a manual actuator 18, for example, a push button, and a control sensor 19, for example an air flow sensor, each operably coupled to the control circuitry 15. The manual actuator 18 may be located on the lid 2*a* of the housing 2 where it can be operated by a user of the article 1. In this example, the sensor 19 is an airflow sensor and is located in the heating chamber 5 towards the rear of the apparatus 1.

The apparatus 1 may further comprise one or more air inlets 20 formed through the housing 2, in this example, through a rear wall 2*b* of the housing 2 and through a base wall 2*c* of the housing 2 towards the mouthpiece 3 end.

In one example, the receptacle 7 is a thin sheet of suitable material having at least one cavity, for example a recess 7*a*, pressed or etched or otherwise formed, therein for containing aerosol generating material 9. As used herein, the word cavity is intended to encompass any hollow space, recess, indent, or the like at least partly defined by the receptacle and for containing aerosol generating material 9.

The receptacle 7 may, for example, be formed of a metal sheet, for example, copper, aluminum, stainless steel, silver, gold or an alloy or from a ceramic material or a metal-plated material.

Figure 3:
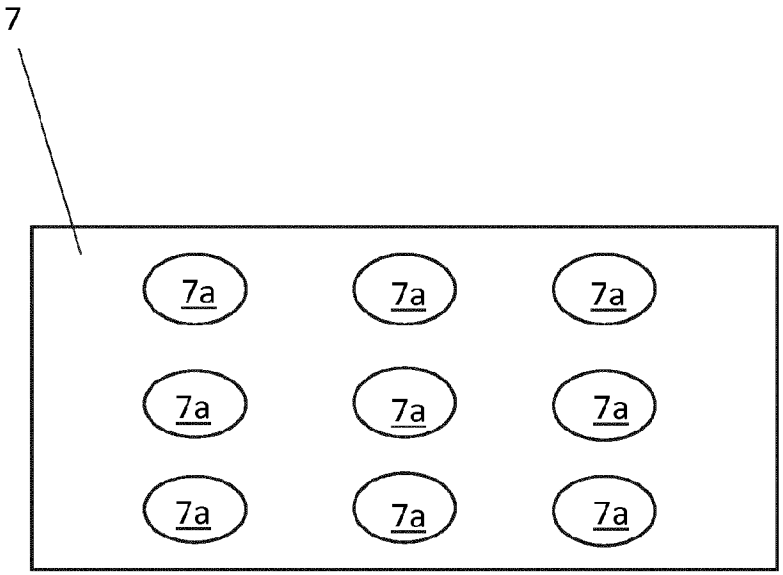
FIG. 3 shows a schematic plan view of an example of a receptacle for aerosol generating material.

As perhaps best seen in FIG. 3, in one example, the receptacle 7 comprises a plurality of recesses 7*a* formed therein, each recess 7*a* for containing aerosol generating material 9. The recesses 7*a* may be arranged in a regular matrix or array, for example, an array of nine as shown in FIG. 3. In the example of FIG. 3, the array of nine recesses 7*a* comprises three 'rows' of three recesses 7*a* arranged parallel with the longitudinal axis of the receptacle 7 and three 'columns' of three recesses 7*a* arranged perpendicular to that longitudinal axis.

A layer of aerosol generating material 9 coats, partially or completely, an inner surface of each recess 7*a*.

In one example of the apparatus 1, the heater arrangement 11 comprises one or more heater elements 11*a* and is located in the heating chamber 5 close to the underside of the receptacle 7. The heater arrangement 11 further comprises power connections 11*b* for connecting the heater elements 11*a* to the electrical control circuitry 15.

In one example, the heater arrangement 11 comprises a plurality of heater elements 11*a* arranged in an array that matches the array of recesses 7*a* formed in the receptacle 7. Accordingly, in the example of FIGS. 2 to 3, the heater arrangement 11 comprises nine heater elements 11*a* in a matching array to the array of recesses 7*a* so that each heater element 11*a* is positioned for heating aerosol generating material 9 in a respective one of the recesses 7*a*.

The electrical control circuitry 15 and the power connections 11*b* to the heater elements 11*a* are arranged in some embodiments such that at least two, or all in one embodiment, of the heater elements 11*a* can be powered independently of each other, for example in turn (over time) or together (simultaneously) as desired.

In an example, the heater elements 11*a* may be resistive heating elements, comprising, for example, resistive electrical wiring wound as a coil or formed as a mesh. In other examples, the heater elements 11*a* may comprise a ceramics material. Examples include aluminum nitride and silicon nitride ceramics, which may be laminated and sintered. Other heating arrangements are possible, including for example the heater elements 11*a* being infra-red heater elements which heat by emitting infra-red radiation or inductive heater elements. An inductive heater element may, for example, comprise an induction coil and a susceptor element. Under the control of the electrical control circuitry 15 the induction coil generates an alternating magnetic field which causes eddy current heating and/or, if the susceptor element is magnetic, magnetic hysteresis heating of the susceptor element. The susceptor element may take any suitable form (e.g. it may itself be a coil) and be formed of any suitable material.

An advantage of the arrangement illustrated in FIGS. 2 to 3 in which the receptacle 7 is separate from the heating arrangement 11 is that the receptacle 7 may be removed by a user from the housing 2 once all the aerosol generating material 9 in the receptacle 7 has been consumed and replaced with a replacement. The receptacle 7 may therefore be a consumable article separate from the remainder of the apparatus 1 and can be disposed of after it has been exhausted. In this way, a new aerosol generating receptacle 7 may be inserted into the heating chamber 5 as required.

To replace a receptacle 7, a user may simply open the lid 2*a* of the housing 2, remove the spent receptacle 7 and then insert a replacement. The lid 2*a* may be attached to the housing 2 by any suitable means, for example, by a hinge, magnetically, or by a recessed lockable sliding arrangement.

In one example, the housing 2 incorporates, or is lined with, insulating material (not shown in the Figures) of sufficient heat transmission retarding qualities that the outer surface of the housing remains sufficiently cool to facilitate comfortable holding. Internally, insulation may be positioned to protect the electrical control circuitry 15 and the power source 17 from elevation of temperature above ambient. In this way the electrical control circuitry 15 and power supply 17 may be protected from potential thermal damage by proximity to the heating arrangement 11.

In some examples, the mouthpiece 3 is removeable from the housing 2 so that should a mouthpiece that has been repeatedly used encounter depositions to the extent that it cannot easily be cleaned, it can be replaced with a new replacement mouthpiece.

In use, heat produced by a heating element 11*a* heats the aerosol generating material 9 in the recess 7*a* above that heating element 11*a* to generate aerosol and/or a gas or vapor. As a user inhales on the mouthpiece 3, air is drawn into the heating chamber 5 through the one or more air inlets 20 (as shown by the broken arrows in FIG. 2) and the combination of the drawn air and aerosol and/or gas or vapor passes into the aerosol formation and condensation zone 6 which cools the hot gas or vapors to form further aerosol and condenses some aerosol so that aerosol is cool entering the mouthpiece 3 for inhalation by a user.

In this example, at least some of the air drawn through the housing 2 when a user inhales passes directly over the heating elements 11*a* and is thus heated and so is hot when mixing with aerosol and/or gas or vapor.

In other examples, air is not drawn over the heating elements 11*a* and passes over the receptacle 7 only.

In yet another example, the apparatus 1 is arranged such that the total volume of inlet air flow is directed over the heating elements 11*a* prior to flowing across the recesses 7*a*, hence ensuring pre-heated air at elevated temperature interacts with the aerosol generating material 9, promoting more effective aerosol generation.

In some examples, the apparatus 1 is arranged so that the total volume of inlet air flow is admitted directly from exterior to the apparatus 1 and is therefore initially at external ambient temperature on entry into the apparatus 1 to flow over the recesses 7*a*. In this case, the air temperature becomes elevated during flow across the recesses 7*a* which may be desirable when volatile flavors or other volatile substances which have sensorial activity are present in the aerosol generating material 9.

In one example, when taking each draw on the mouth piece 3, in order to initiate heating, a user may actuate the actuator 18 to cause the power supply 17 under the control of the control circuitry 15 to supply power to one or more of the heating elements 11*a*.

In one example, heating may be initiated automatically each time a user takes a draw on the mouth piece 3 by means of the sensor 19, for example, an air flow sensor, causing the power supply 17 under the control of the control circuitry 15 to supply power to one or more of the heating elements 11*a*.

In another example, heating may be initiated manually prior to each draw, and the sensor 19 automatically switches electrical power off after each draw has been completed and air flow reverts to near zero in the apparatus 1. In this way battery power may be preserved, but the user can manually control switching the heating elements 11*a* to the on position.

In examples in which the heater elements 11*a* can be powered independently of each other, the particular heating element 11*a* or combination of heating elements 11*a* that are powered on each given draw may vary from draw to draw in accordance with a predetermined power control sequence controlled by the control circuitry 15.

In one embodiment, the heating elements 11*a* can be powered sequentially, one per draw by a user, such that aerosol and/or gas is generated in a consistent basis on each draw.

Activation of each heating element 11*a* can result in a flash vaporization of the aerosol generating material 9 in the recess 7*a* being heated by a heating element 11*a*. To this end, as an example only, activation of each heating element 11*a* heats the aerosol generating material 9 in the recess 7*a* being heated to between 140 to 300 degrees Celsius, for example to between 180 degrees to 250 degrees Celsius. It will be appreciated that a heating element 11*a* itself may be controlled so as to reach any temperature between 200 to 800 degrees Celsius and that temperature may be tailored to meet the requirements for aerosol generation in a particular case.

The electrical power drawn by each heating element 11*a* can be controlled by pre-programming the electrical control circuitry 15 to suit the individual heating requirements of each of the plurality of recesses 7*a* containing aerosol generating material 9 formed in the receptacle 7.

It will be appreciated that any combination of materials discussed herein could be placed in any given recess 7*a*.

In one example, the aerosol generating material 9 in at least one of the recesses 7*a* comprises a flavorant material, for example, menthol. In this example, the aerosol generating material 9 in the at least one of the recesses 7*a* may comprise a flavorant material and little or no tobacco based material. It will be appreciated that a heating element 11*a* arranged to heat aerosol generating material 9 in a recess 7*a* that comprises flavorant but no tobacco based material need not heat the aerosol generating material 9 to the same temperature or extent as that required for aerosol generating material 9 that does comprise a tobacco based material. For example, temperatures as low as 55 to 65 degrees C. may be sufficient to cause the release of an acceptable amount of flavor.

The aerosol generating material 9 in different recesses 7*a* may comprise different flavorants.

In one example, one or more of the heating elements 11*a* are automatically controlled upon the sensor 19 detecting a draw being taken and one or more other of the heating elements 11*a* are manually controlled by the actuator 18.

The manually controlled heating elements 11*a* may be for heating a particular flavorant which the user may wish to control when that flavorant is released.

The temperature to which aerosol generating material 9 comprising flavorant is heated may also be varied (for example, by the user varying the duration for which the actuator is actuated) to vary the taste intensity of the flavorant experienced by the user.

Although in FIG. 2 each heater element 11*a* is illustrated as being generally linear in shape this need not be the case. In one example, each heater element has a curved shape the curvature of which generally matches that of the recess that it is arranged to heat. This arrangement facilitates a uniform heating of the aerosol generating material in a recess and may provide a good heating rate.

In an example, the receptacle 7 may comprise a protective layer (not shown) overlying the recess or recesses 7*a* to seal the aerosol generating material 9 in the recess or recesses 7*a*. A user may remove the protective layer, for example, by peeling it off, to expose the aerosol generating material 9 in each recess or recesses 7*a*, either prior to or after fitting the receptacle 7 into the housing 2. Once the replacement receptacle 7 has been fitted into the housing 2, the user can close the lid 2*a* of the housing 2 so that the apparatus is ready for use.

The protective layer (not shown) may comprise any suitable material, for example, a polyimide such as Kapton™, paper, polymer, cellophane or aluminum foil and may be attached to the receptacle 7 by any suitable means, for example, glue.

The protective layer is preferably heat resistant and does not contribute adversely to the taste of the aerosol generating material 9 perceived by a user.

In examples in which the receptacle 7 is fitted into the housing 2 and the lid 2*a* is closed without the user first being required to remove the protective layer, the apparatus 1 is provided with means for rupturing the protective layer above each of the recesses 7*a* to expose the aerosol generating material 9 in the recesses 7*a* prior to the recesses 7*a* being heating for aerosol generation.

In one example, the receptacle 7 is in the form of a so called 'blister pack' with the regions of the protective layer above the recesses 7*a* being easily rupturable to expose the aerosol generating material 9 in the recesses 7*a*. The underside of the lid 2*a* of the housing 2 may define a pattern of formations (not shown) having the same spatial arrangement as the recesses 7*a* and which when the lid 2*a* is pressed down into the closed position by a user ruptures those regions of the protective layer above the recesses 7*a* to expose the aerosol generating material 9 in the recesses 7*a*.

In another example, a rupture mechanism is included in the apparatus 1 which ruptures the protective layer above one or more of recesses 7*a* each time a user actuates the actuator 18 or automatically each time the sensor 19 detects that a user is taking a draw on the mouth piece 3.

Figure 4:
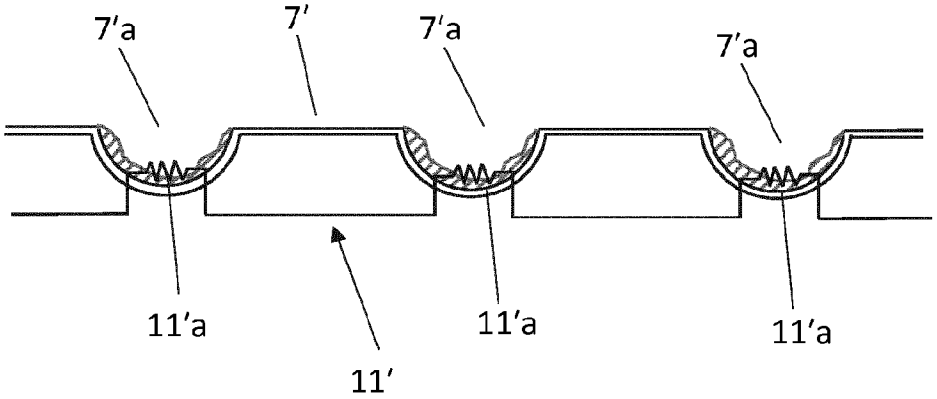
FIG. 4 shows a schematic longitudinal cross-sectional view of an example of a receptacle for aerosol generating material and a heating arrangement.
Figure 5:
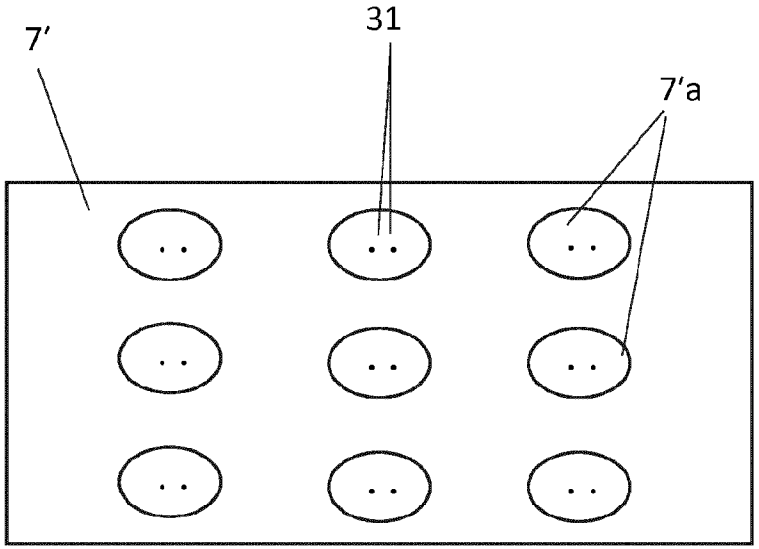
FIG. 5 shows a schematic plan view of an example of a receptacle for aerosol generating material.

Referring now to FIGS. 4 and 5, there is illustrated an alternative example of a receptacle 7' and heating arrangement 11'. In this example, the receptacle 7' is similar to the receptacle 7 described above and the heating arrangement 11' comprises one or more heating elements 11'*a* but heating element 11'*a* is located inside a respective one of the recesses 7'*a*. In this example, the aerosol generating material 9 in a recess 7'*a* coats the heating element 11'*a* that is in that recess 7'*a*.

In this example, each heating element 11'*a* is a coil (for example a flat or hemispherical or spiral coil) or mesh formed of resistive electrical wiring. In this example, the aerosol generating material 9 in each recess 7'*a* coats the coil or mesh heating element 11'*a* in that recess 7*a*. An advantage of this arrangement is that it facilitates consistent flash vaporization of the aerosol generating material in a recess 7'*a*. Furthermore, with this configuration, for example, the length of each coil or mesh may be selected so as to achieve a particular heat transfer characteristic.

As illustrated in FIG. 5, in this alternative example of a receptacle 7', a pair of holes 31 is formed through the receptacle 7' in each of the recesses 7'*a* to enable the power connections 11*b* to be connected to the heater elements 11'*a*.

Figure 6:
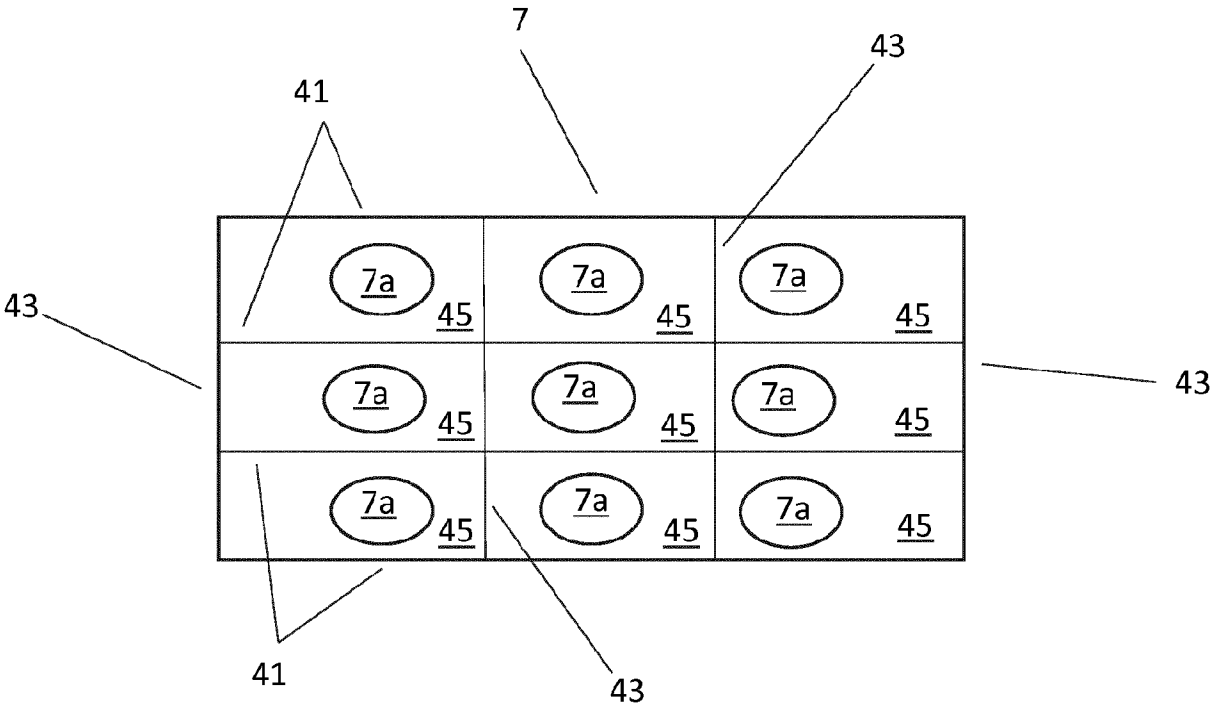
FIG. 6 shows a schematic plan view of an example of a receptacle for aerosol generating material.

Referring now to FIG. 6, a receptacle 7 may comprise a first plurality of walls 41 extending upright from the base of the receptacle 7 and running parallel to the longitudinal axis of the receptacle and a second plurality of walls 43 also extending upright from the base of the receptacle and running perpendicular to the longitudinal axis of the receptacle and which together define a plurality of compartments 45 each containing a respective one of the cavities 7*a*, in this example, recesses 7*a*. Sufficient headspace is provided between the compartments 45 and the underside of the lid 2*a* of the housing 2 to allow for circulation of aerosol and/or gas.

Alternatively, the first plurality of walls 41 the second plurality of walls 43 that define the compartments 45 may be part of the internal structure of the housing 2 rather than being integral with the receptacle 7.

Advantageously, the walls 41 and 43 may act as heat barriers. Accordingly, providing each recess in a separate compartment in this way may inhibit the conduction of heat away from the recesses 7*a* so that the aerosol generating material 9 is efficiently heated.

Figure 7A:
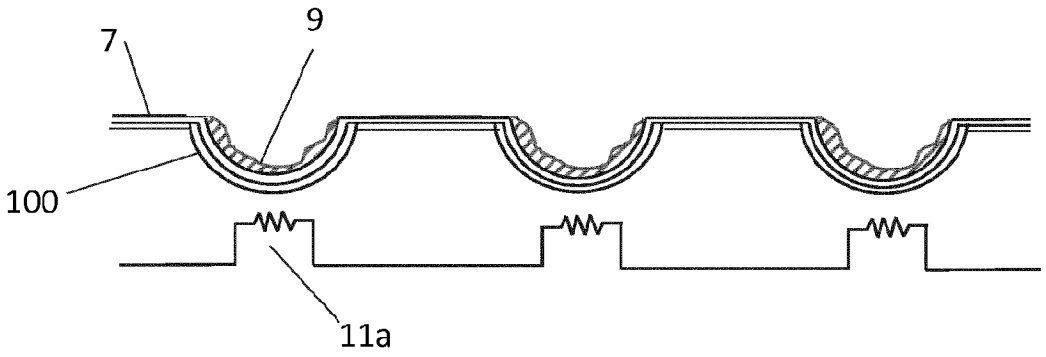
FIG. 7*a* shows a schematic longitudinal cross-sectional view of an example of a receptacle for aerosol generating material and a heating arrangement.
Figure 7B:
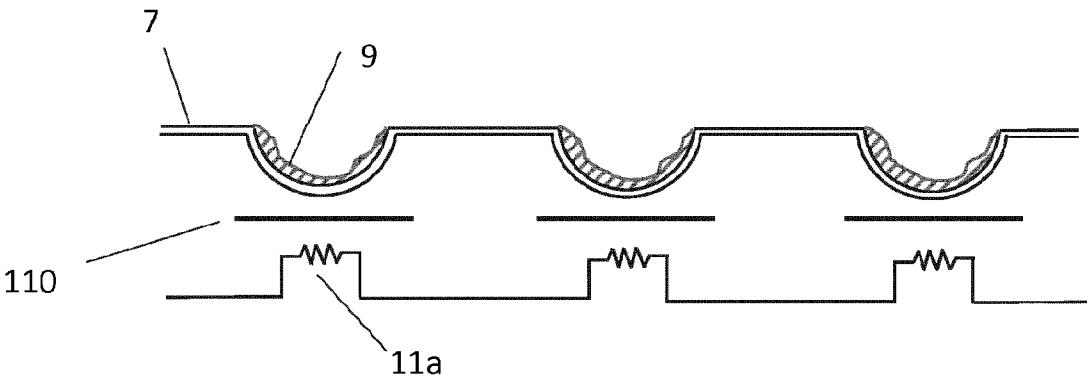
FIG. 7*b* shows a schematic longitudinal cross-sectional view of another example of a receptacle for aerosol generating material and a heating arrangement.

As is schematically illustrated in FIGS. 7*a* and 7*b*, in some examples, particularly those in which the receptacle 7 comprises an electrically conductive material, an electrical insulator 100, 110 may be provided between the heating elements 11*a* and the receptacle 7 to prevent electrical shorts occurring between them. The electrical insulator 100, 110 may, for example, comprise a polyimide such as Kapton™. As illustrated in the example of FIG. 7*a*, the electrical insulator 100 may be in the form of a layer of electrically insulating tape attached to the underside (i.e. the side facing the heating elements 11*a*) of the receptacle 7. Alternatively, as illustrated in FIG. 7*b*, an electrical insulator 110 may be provided that is separate from the receptacle 7 but which forms a barrier between the heating elements 11*a* and the underside of the receptacle 7. The barrier may be in the form of a continuous sheet that separates substantially all of the underside of the receptacle 7 from the heating elements 11*a* or, as is illustrated in FIG. 7*b*, a plurality of discrete sections, each of which sections is positioned between a heating element 11*a* and the part of the underside of the receptacle 7 that that heating element 11*a* is for heating.

Figure 7C:
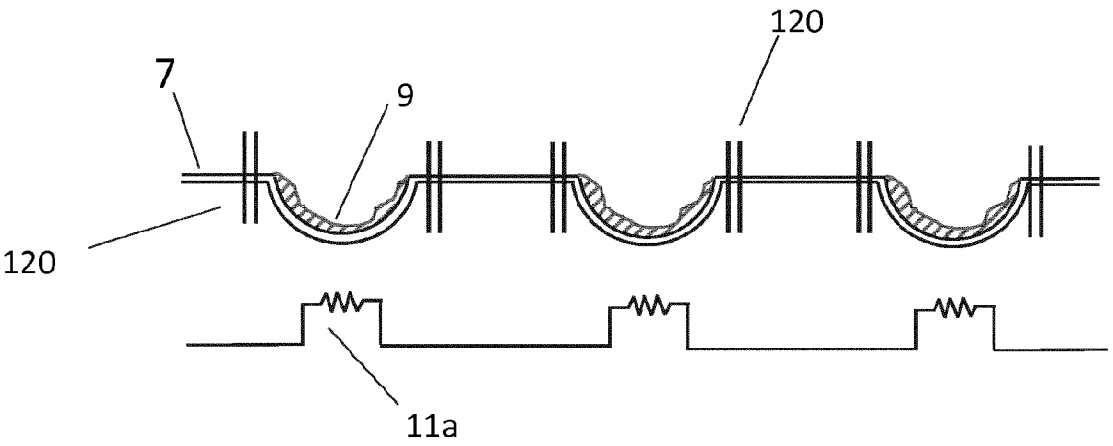
FIG. 7*c* shows a schematic longitudinal cross-sectional view of another example of a receptacle for aerosol generating material and a heating arrangement.

As is illustrated in FIG. 7*c*, in some examples, a thermal barrier 120 (represented by pairs of vertical lines) is located around the periphery of each recess of the receptacle 7 so as to inhibit the conduction of heat away from the recesses to ensure that the aerosol generating material 9 is sufficiently heated.

Examples of suitable materials for thermal barriers include: ceramics, aerogel materials (incorporating a foamed internal structure—foamed silica aerogels) fibrous insulating materials for example inorganic fibers.

Figure 8A:
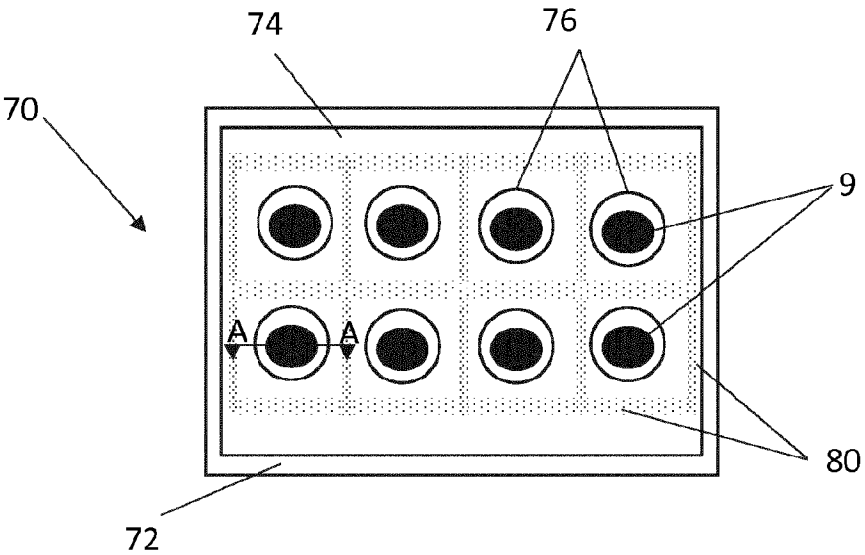
FIG. 8*a* shows a schematic plan view of another example of a receptacle for aerosol generating material.
Figure 8B:
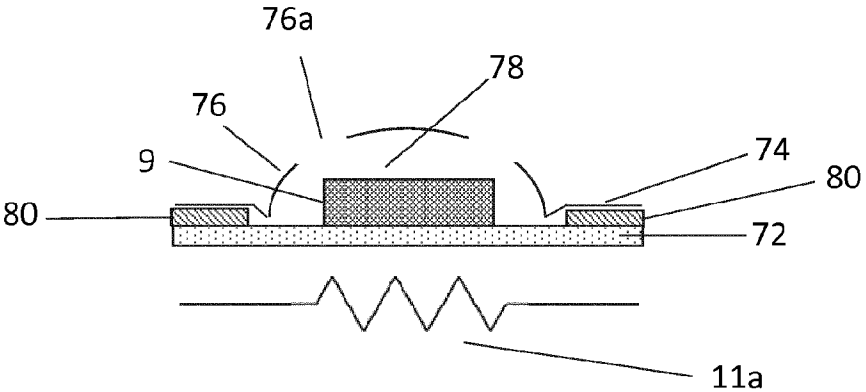
FIG. 8*b* shows a schematic cross sectional view through the line A-A in FIG. 8*a*.

Referring now to FIGS. 8*a* and 8*b*, there is schematically illustrated an example of an alternative receptacle 70 that can be used in the apparatus 1 instead of the receptacle 7.

The receptacle 70 comprises a flat plate 72 and a blister pack 74 attached to a surface of the flat plate 72 to define a lid. The blister pack 74 comprises a plurality of generally hemispherical blisters 76 arranged in an array, in this example, an array comprising two rows and four columns. Each blister 76 covers a respective part of the surface of the flat plate 72 and co-operates with that part of the surface to define a cavity 78 containing aerosol generating material 9. The aerosol generating material 9 rests on the surface within each cavity 78.

The flat plate 72 may comprise any suitable heat conductive and resistant material, for example, a polyimide such as Kapton™, or a metal such as aluminum. The blister pack 74 may comprise any suitable heat resistant material, for example, a suitable polymer, a foil, or laminated films.

The blister pack 74 may be attached to the flat plate 72 by attachment means 80. In one example, the attachment means 80 is an adhesive, for example a glue such as Polyvinyl acetate (PVA).

As schematically illustrated in FIG. 8*a*, the adhesive 80 may be located between the surface of the flat plate 72 and the blister pack 74 as a grid of criss-crossing adhesive tracks (illustrated by dotted lines in FIG. 8*a*) which securely fix the blister pack 74 to the surface of the flat plate 72.

During the manufacturing of the receptacle 70, a stencil (not shown) may be used to ensure a correct placement of the aerosol generating material 9 and of the tracks of adhesive 74.

In use, the receptacle 70 is placed within the heating chamber 5 of the apparatus 1 (as described in the example above in respect of the receptacle 7), so that each cavity 78 is above a respective one of the heater elements 11*a* of the heater arrangement 11. The heater arrangement 11 and its associated control circuitry 15 may be used to heat the receptacle 70 in any of the ways described above in respect of the receptacle 7. As illustrated in FIG. 8*b*, each blister 76 has one or more holes 76*a* to allow aerosol and/or a gas or vapor from the aerosol generating material 9 to exit a cavity 78.

In one example, the one or more holes 76*a* are formed in the blisters 76 prior to the receptacle 70 being inserted into the housing 2. For example, the one or more holes may be formed during the manufacturing of the receptacle 70 or by a user. In another example, the apparatus itself is provided with a means of forming the one or more holes 76*a* when the receptacle 70 is in the housing 2.

One advantage of an entirely sealed blister pack is that shelf life/freshness of the aerosol generating material 9 is preserved.

An advantage of the type of receptacle 70 in this example is that it allows for the aerosol generating material 9 to be heated to a temperature sufficient to generate an aerosol without undesirable heat damage being caused to the blister pack 74 itself.

Figure 9:
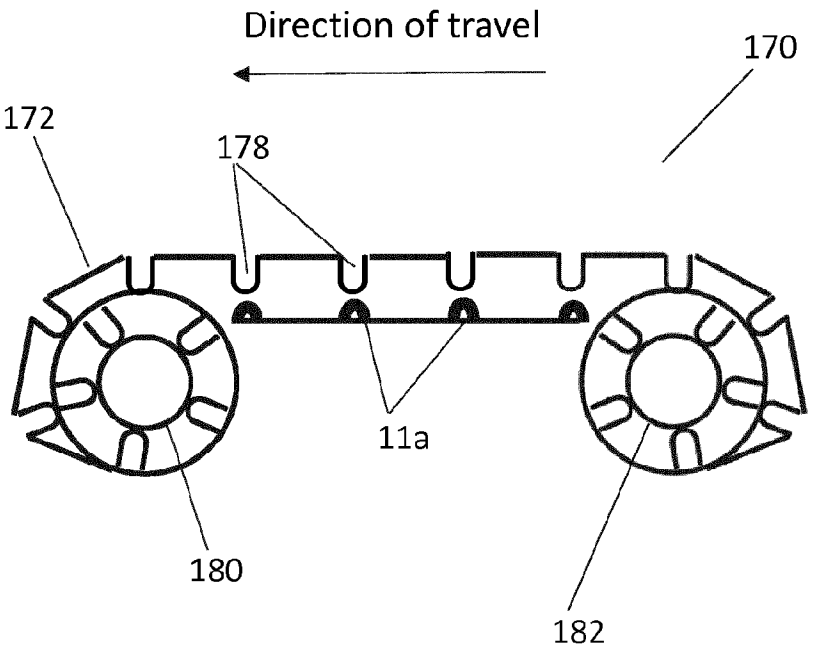
FIG. 9 shows a schematic longitudinal cross-sectional view of another example of a receptacle for aerosol generating material and a heating arrangement.
Figure 10:
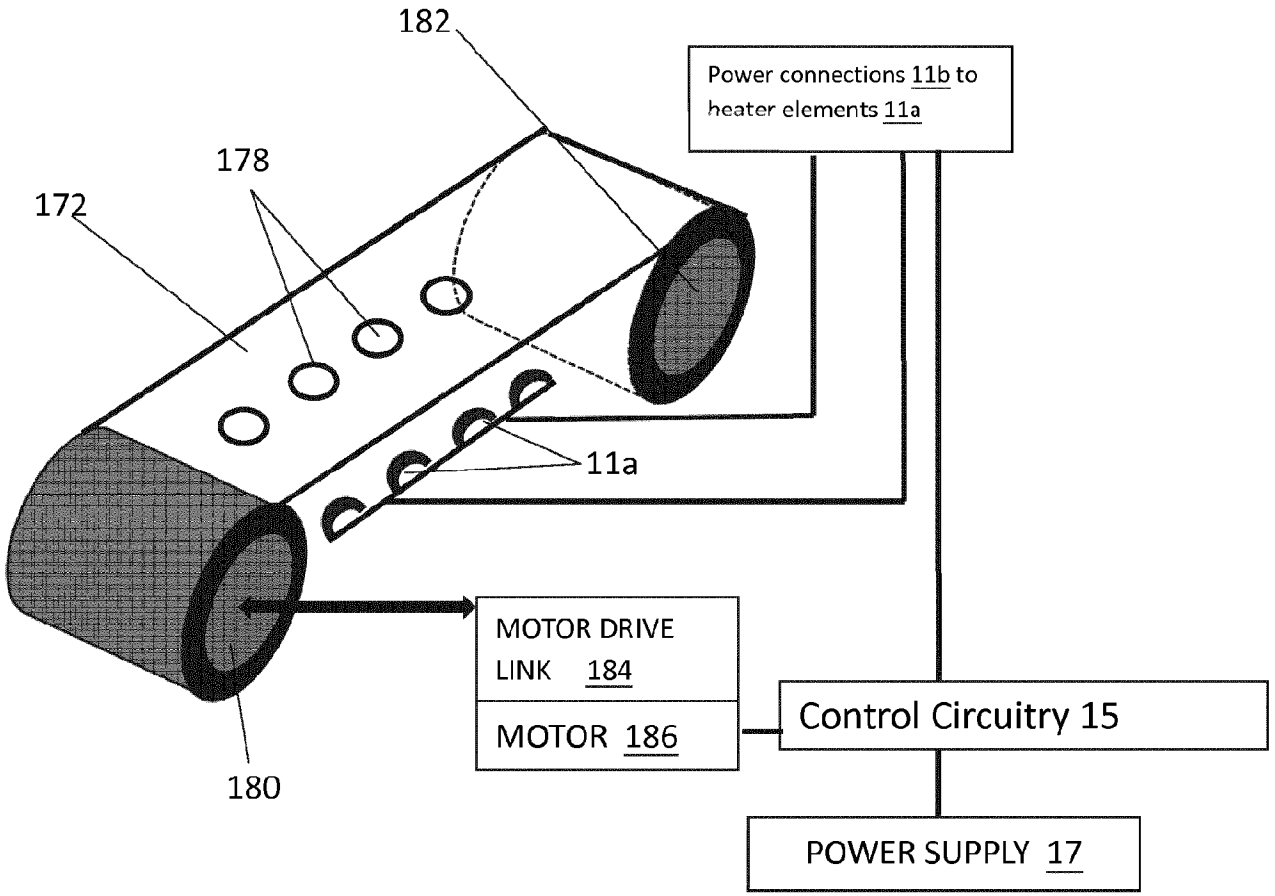
FIG. 10 shows a schematic perspective view of the receptacle and heating arrangement of FIG. 9 together with schematics of drive and power control circuitry.

Referring now to FIGS. 9 and 10, there is schematically illustrated an example of another alternative receptacle 170 that can be used in the apparatus 1 instead of the receptacle 7.

The receptacle 170 comprises a strip of flexible material 172 comprising one or more cavities 178 each provided by forming, for example etching, pressing or indenting a recess into the strip 172. As illustrated in FIGS. 9 and 10, a plurality of such cavities 178 may be positioned at regular intervals longitudinally along the strip 172.

Each of the cavities 178 may contain aerosol generating material 9 as described in the previous embodiments.

The strip 172 may, for example, comprise a thin metal sheet of, for example, copper, aluminum, stainless steel, silver, gold or an alloy, or comprises a thin metal plated sheet or a ceramic sheet.

The receptacle 170 may further comprise a protective sealing strip or film (not shown in the FIGS. 9 and 10) which overlies the strip 172 to seal the aerosol generating material 9 within the cavities 178. The sealing strip may be attached to the strip 172 in any suitable way, for example, by being heat sealed or by being glued. The sealing strip may comprise any suitable heat resistive material, for example, a polyimide such as Kapton™, or metal such as those listed in the previous paragraph, or a suitable polymer or foil.

The receptacle 170 further comprises a pair of spaced apart cylindrical spools 180, 182 to which the strip 172 is attached. The strip 172 is wrapped from one of its ends around a first of the spools 180 and wrapped from its other end around a second of the spools 182.

In use, the receptacle 170 is mounted within the heating chamber 5 of the apparatus 1 and one of the first 180 and second 182 spools, in this example the first spool 180, is connected by a motor drive link 184 to a motor 186 located in the housing, for example, in the electronics/power chamber 13, which, when activated rotatably drives the first spool 180. As the first spool 180 rotates, a further amount of the strip 172 is wound around the first spool 180 and a corresponding amount of the strip 172 is wound off the second spool 182 as the strip 172 is drawn onto the first spool 180 as indicated by the direction of travel arrow in FIG. 9.

Each of a plurality of cavities 178 containing aerosol generating material 9 (not shown in FIGS. 9 and 10) may be positioned directly above a respective heating element 11*a* of a plurality of heating elements 11*a*, as illustrated in FIGS. 9 and 10, so that when a required heating element 11*a* or elements 11*a* are activated, aerosol and/or gas/vapor is generated accordingly. Once the aerosol generating material in one or more of the cavities 178 has been used, activating the motor 186 to rotate the first spool 180 causes the section of the strip 172 having the spent cavity or cavities 178 to be wound around the first spool 180 and a new section of the strip 172 having one or more un-used cavities 178 to be unwound from the second spool 182 thus positioning one or more fresh unused cavities 178 containing aerosol generating material over the heating elements 11*a*.

The movement of the strip 172 may automatically occur following one or more of the heating elements 11*a* being activated, either in response to a user manually actuating the actuator 18 or the sensor 19 detecting a draw on the mouth piece 3.

As schematically illustrated in FIG. 10, the power supply 17 may be used to power the motor 186 and, via power connections 11*b*, the heating elements 11*a*. The control circuitry 15 may be configured to ensure that there is a correct timing between the activation of the heating elements 11*a* and the motor 186.

Once all of the cavities 178 in the receptacle 170 have been exhausted of aerosol generating material 9, the receptacle 170 can be removed from the housing 2 and replaced with a new one.

If the receptacle 170 comprise a protective sealing strip or film which overlies the strip 172 which seals the aerosol generating material in the cavities 178, then the apparatus 1 may be provided with a means for perforating the sealing strip above each cavity 178 to provide one or more holes to allow aerosol and/or a gas or vapor from the aerosol generating material 9 to exit the cavity 178.

In the examples described above, the housing 2 of the apparatus 1 is provided with a lid 2*a* to provide access to the heating chamber 5 in order to allow user to insert and remove a receptacle 7. In an alternative example, illustrated schematically in FIG. 11, the apparatus 1 is modular and comprises a power chamber 13*a* containing a power supply (e.g. battery), an electronics chamber 13*b* containing the control circuitry, the heating chamber 5 and a combined aerosol formation (cooling) chamber and mouth piece 3. At least the section of the apparatus 1 that defines the heating chamber 5 is separable from another section of the apparatus 1 to enable a receptacle 7 (not shown in FIG. 11) to be inserted into the heating chamber 5 for use and then removed after all of the aerosol generating material 9 has been consumed.

The section of the apparatus 1 that defines the power chamber 13*a* may also be separable to enable batteries to be inserted into or removed and to provide access to the control circuitry. Finally, as already mentioned above, the mouthpiece/aerosol formation chamber 3 may be separable from the rest of the apparatus 1 in order to facilitate cleaning of the apparatus 1.

Figure 11:
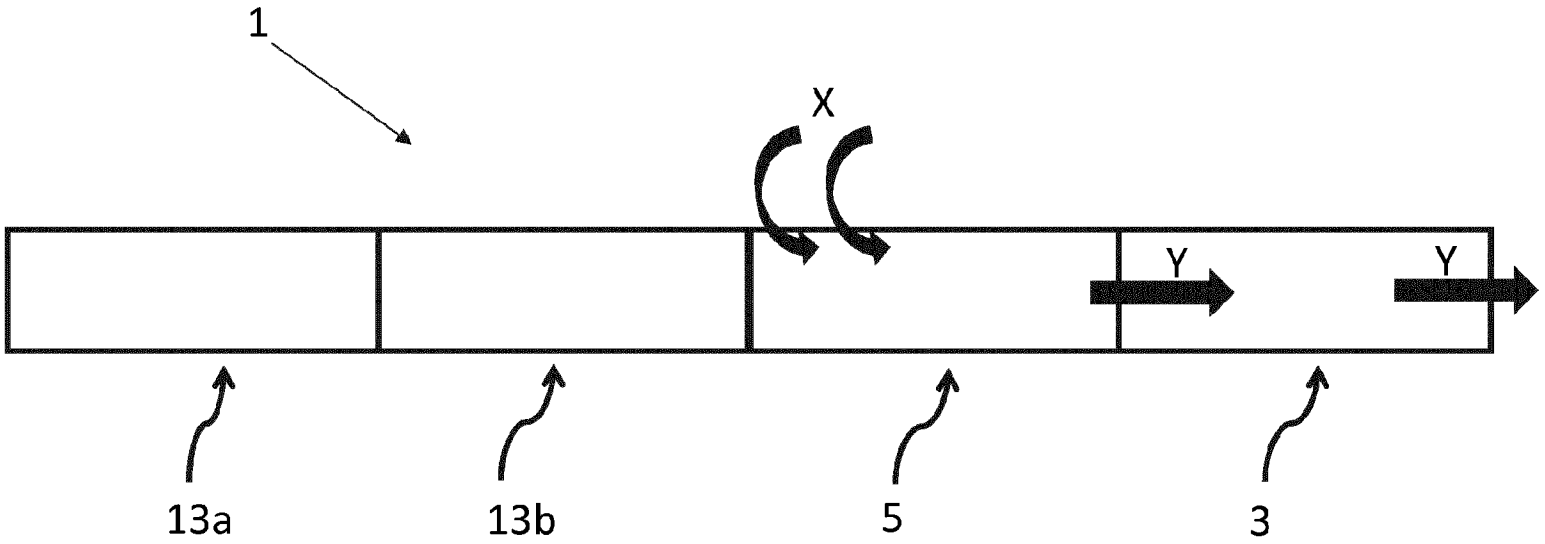
FIG. 11 shows a schematic view of a modular apparatus for heating an aerosol generating material.

As is illustrated in FIG. 11, the arrows X indicate air flow through the heating chamber 5 during a draw taken by a user and the arrows Y indicate air flow through the aerosol formation chamber and mouthpiece 3 during a draw.

Figures 12A, 12B, 12C:
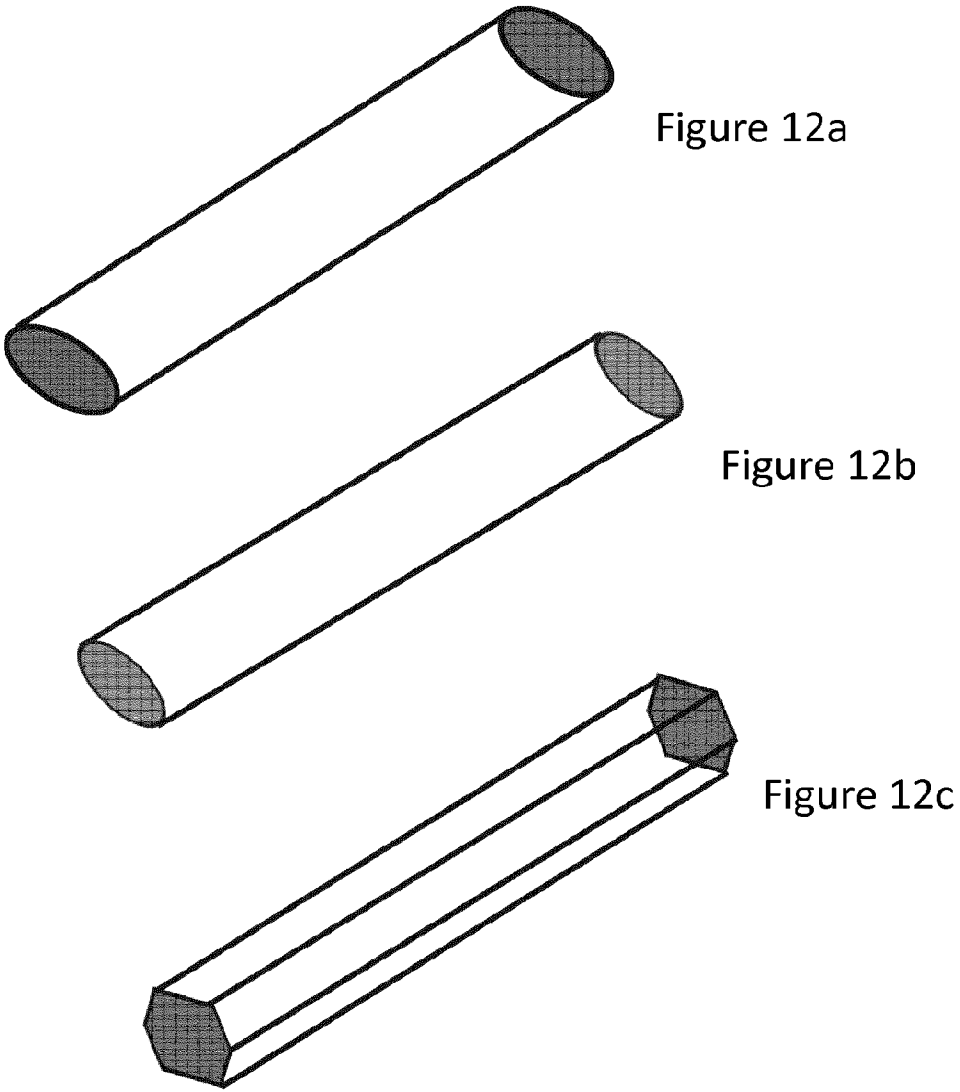
FIGS. 12*a* to 12*c* show schematic perspective views of different device shapes.

In the example described in FIG. 1, the apparatus 1 is predominantly rectangular in cross section. In alternative examples, the apparatus 1 may comprise any suitable shape, for example, a generally oval cross section as illustrated in FIG. 12*a*, a generally circular cross section as illustrated in FIG. 12*b* and a polygonal cross section, for example, hexagonal as illustrated in FIG. 12*c*.

Although in the above described examples, the apparatus 1 comprises a single receptacle 7, 70, 170 in the heating chamber 5, in alternative examples, the apparatus 1 comprises a plurality of receptacles arranged, for example, in a stacked configuration in the heating chamber 5.

Figure 13:
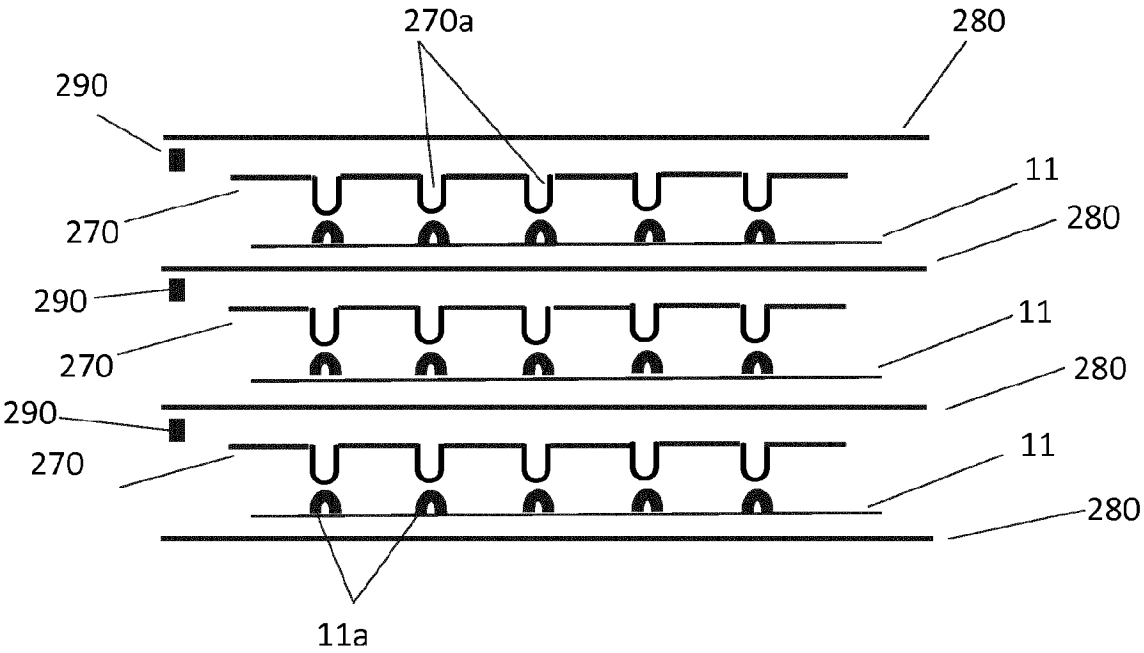
FIG. 13 is a schematic diagram illustrating a stacked configuration of heater arrangements and receptacles.

As is schematically illustrated in FIG. 13, in one such stacked arrangement, a plurality of receptacles 270 and a plurality of heater arrangements 11 are provided with each heater arrangement 11 being for heating a respective one of the receptacles 270. Each heater arrangement 11 again comprises a plurality of heater elements 11*a* (for clarity only two are labeled in FIG. 13) each positioned to heat a cavity 270*a* in its associated receptacle 270. Each receptacle 270 may take, for example, the form of any of the previously described receptacles and comprises one or more cavities 270*a* (for clarity only two are labeled in FIG. 13) for containing, for example, any of the previously described aerosol generating materials. Again, each receptacle 270 may be provided with a sealing cover (not shown in FIG. 13) for sealing the aerosol generating material in the cavities 270*a*. Any sealing cover may be removed or punctured by a user prior to use or the apparatus 1 may be provided with means for puncturing the sealing cover to enable aerosol and/or gas to be generated in use.

Each receptacle 270 and its associated heater arrangement 11 define a pair and the pairs of receptacles 270 and heater arrangements 11 are stacked one above the other in the heating chamber (not shown in FIG. 13) at regular intervals. Each receptacle 270 and heater arrangement 11 pair may be positioned between barrier layers 280 which provide thermal and/or electrical insulation between pairs. Each barrier layer 280 may comprise any suitable material for thermally and/or electrically insulating a receptacle 270 and heater arrangement 11 pair, for example, metal, alloy, plated metal or heat resistant plastics.

Each of the heater arrangements 11 is connected to the electrical control circuitry 15 (not shown in FIG. 13) of the apparatus 1. The electrical control circuitry 15 may be arranged so that each of the heater elements 11*a* in any given heater arrangement 11 are controllable in any of the ways described previously.

The electrical control circuitry 15 may be arranged so that each heating arrangement 11 is independently operable from the other heater arrangements 11. The electrical control circuitry 15 may be arranged so that plural heater elements 11*a* in the same heater arrangement 11 are simultaneously operable and/or plural heater elements 11*a* in different heater arrangements 11 are simultaneously operable.

In one example, the electrical control circuitry 15 is arranged so that use is made of one of the heater arrangements 11 until all of (or most of) the aerosol generating material in that heater arrangement's 11 receptacle 270 has been consumed at which time the electrical control circuitry 15 is used to switch to using a different one of the heater arrangements 11 and so on until all of (or most of) the aerosol generating material in the apparatus 1 has been consumed. In some examples, a user may manually control the control circuitry 15 to switch from making use of one heating arrangement 11 to another of the heating arrangements 11 when that user discerns that the currently used receptacle 270 is no longer producing sufficient aerosol. In other examples, the control circuitry 15 may automatically switch from using one heating arrangement 11 to another of the heating arrangements 11 in response to a sensor 290 indicating that the currently used receptacle 270 is no longer producing sufficient aerosol.

It will be appreciated that with such stacked arrangements, the time period between a user having to replace receptacles in the apparatus 1 is increased.

Although in the above examples the cavities are illustrated as being generally oval in plan-view, it will be appreciated that this is for the purpose of ease or illustration only and that the cavities may have any suitable shape (for example circular or a flattened oval in plan-view).

In each of the described embodiments above, the heating elements may take any suitable form, including the examples of resistive heating elements, infra-red heating elements and inductive heating elements as previously described.

Figure 14:
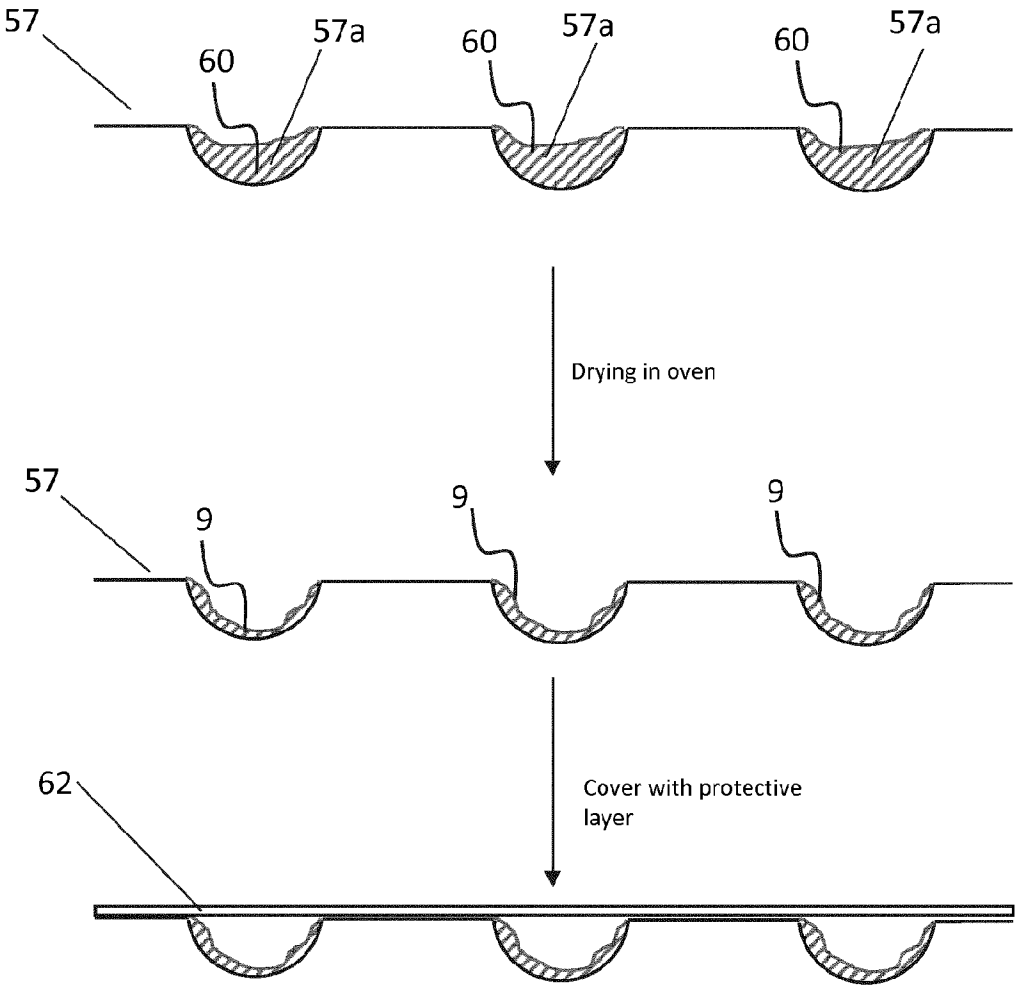
FIG. 14 shows steps in providing a receptacle having one or more recesses containing an aerosol generating material.

Referring to FIG. 14, there will now be described an example of a method of providing a receptacle, such as the previously described receptacle 7, containing material for generating an aerosol.

In a first step, a plurality of recesses 57*a* arranged in a matrix or array in a receptacle 57 are filled with a wet aerosol generating material 60. The aerosol generating material 60 may comprise, for example, a combination of one or more of glycerol, tobacco extract, nicotine, tobacco extract flavor, binders, thickeners such as alginate, gums and chalk. The aerosol generating material 60 is in the form of a wet gel, slurry, liquid or the like and comprises a relatively large percentage per weight of water.

The aerosol generating material may comprise, for example:

On a dry weight basis
Chalk 0-75%
Glycerol 10-60%
Alginate 1-30%

Nicotine 0-4%
Tobacco extract 0-50%
with a water content of 40 to 90%

In a second step, the receptacle 57 is placed in a drying environment, for example, in an oven (not shown), for drying in order to reduce the percentage per weight of water of the aerosol generating material 60 to a relatively small amount, resulting in a dry aerosol generating material 9 (similar to that described above) in which the percentage per weight of water is relatively small compared to that of the wet aerosol generating material 60. In one example, the receptacle 57 is placed in an oven at around 45 degrees Celsius over a few hours, for example, 2 to 4 hours. In another example, the receptacle is placed in an oven at around 60 to 80 degrees Celsius, for 10 to 60 minutes or dried at 100 to 110 degrees Celsius for 5 to 20 minutes.

Typically, the percentage of water of the aerosol generating material 60 is reduced from a start percentage per weight of around 40 to 90% to an end percentage per weight of around 5 to 40%.

The dry aerosol generating material 9 may for example comprise a dried gel.

In some examples, if not already present, tobacco extract is sprayed or otherwise deposited on the dry aerosol generating material 9. In other examples, if not already present, tobacco extract is sprayed or otherwise deposited on the aerosol generating material 9 prior to drying.

In a third step, the receptacle 57 is cut into a plurality of smaller sections (not shown), each smaller section comprising a matrix or array of recesses containing the dry aerosol generating material 9. The matrix or array of recesses may for example be a 9×9 matrix or array as described above.

In a fourth step, a protective layer 62 is provided to overlie the recess or recesses 57*a* of each smaller section to seal the aerosol generating material 9 in those recess or recesses 57*a* in order to preserve the flavorsome properties of the aerosol generating material 9.

The protective layer may take the same form as any of the protective layers previously described above in respect of the receptacle 7.

Although in the above example the wet aerosol generating material 60 is treated by heating to reduce the percentage of water that it contains, it should be appreciated that other treatments can be used to the same effect. For example, the wet aerosol generating material 60 in the recesses 57*a* may be freeze dried to reduce the percentage of water that it contains.

An advantage of providing aerosol generating material in the recess or recesses that is relatively dry is that, in use, in an apparatus such as the apparatus 1, when the aerosol generating material is heated to generate an aerosol and/or gas, that aerosol and/or gas has a temperature that is comfortable for the user. This is in contrast with aerosol and/or gas generated in similar circumstances from aerosol generating material that has a relatively high water content and which at least occasionally, because of the high water content, can generate aerosol and/or gas that has a temperature that is un-comfortably hot for the user. Additionally, there is reduced energy consumption on heating because there is a reduced amount of excess water to heat.

Embodiments of the disclosure are configured to comply with applicable laws and/or regulations, such as, by way of non-limiting example, regulations relating to flavors, additives, emissions, constituents, and/or the like. For example, embodiments may be configured such that a device implementing the invention is compliant with applicable regulations before and after adjustment by a user. Such implementations may be configured to be compliant with applicable regulations in all user-selectable positions. In some embodiments, the configuration is such that a device implementing the invention meets or exceeds required regulatory test(s) in all user-selectable positions, such as, by way of non-limiting example, the testing threshold(s)/ceiling(s) for emissions and/or smoke constituents.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. An apparatus for heating an aerosol generating material to generate an inhalable aerosol and/or gas, the apparatus comprising:

a housing;

a receptacle within the housing, the receptacle comprising a plurality of cavities, each cavity for containing an aerosol generating material, wherein the receptacle comprises a sheet or a flexible strip and each of the cavities is defined at least in part by the sheet or the flexible strip; and a heating arrangement comprising a plurality of heater elements, wherein each heater element is arranged externally of a respective one of the plurality of cavities and is for heating aerosol generating material contained in the respective one of the plurality of cavities to generate an inhalable aerosol and/or gas.

2. The apparatus as claimed in claim 1, wherein the apparatus is arranged so that the receptacle is removeable from the housing so that the receptacle can be replaced with a replacement receptacle.

3. The apparatus as claimed in claim 1, wherein a portion of the housing is openable or releasable to provide access to the receptacle.

4. The apparatus as claimed in claim 1, comprising power circuitry arranged for powering the plurality of heater elements, wherein the power circuitry is arranged so that the heater elements can be selectively powered independently of each other.

5. The apparatus as claimed in claim 1, comprising power circuitry arranged for powering the plurality of heater elements, wherein the power circuitry is arranged to power the plurality of heater elements so that at least a first heater element of the plurality of heater elements heats to a lower temperature than does at least a second heater element of the plurality of heater elements, and wherein the at least a first heater element is for heating first aerosol generating material comprising a flavorant contained in a first one of the plurality of cavities and the at least a second heater element is for heating second aerosol generating material comprising a tobacco based material contained in a second one of the plurality of cavities.

6. The apparatus as claimed in claim 5, wherein the power circuitry is arranged so that a temperature to which the first heater element can heat the first aerosol generating material can be varied.

7. The apparatus as claimed in claim 1, wherein at least one cavity of the plurality of cavities contains an aerosol generating material that comprises a tobacco based material, and at least one different cavity of the plurality of cavities contains an aerosol generating material that comprises a flavorant.

8. The apparatus as claimed in claim 1, the apparatus further comprising means for rupturing a barrier layer provided on the plurality of cavities to expose aerosol generating material contained in the plurality of cavities.

9. The apparatus as claimed in claim 1, further comprising an electrically insulating barrier located between the receptacle and the plurality of heating elements.

10. The apparatus as claimed in claim 1, the apparatus comprising a thermal barrier for inhibiting heat from conducting away from at least one of the plurality of cavities.

11. The apparatus as claimed in claim 1, wherein each cavity is provided within a separate compartment on the receptacle.

12. The apparatus as claimed in claim 1, wherein the receptacle comprises the sheet, and wherein each of the plurality of cavities comprises a recess formed in the sheet.

13. The apparatus according to claim 12, wherein each of the plurality of recesses is etched or pressed into the sheet.

14. The apparatus as claimed in claim 1, wherein the receptacle comprises the sheet, and the sheet comprises a flat surface and a barrier layer covering at least a portion of the flat surface, and wherein each of the one or more cavities is defined by a part of the barrier layer and a part of the flat surface covered by that part of the barrier layer.

15. The apparatus as claimed in claim 14, wherein the barrier layer is a blister pack, and wherein each of the one or more cavities is defined by a blister of the barrier layer and a part of the flat surface covered by that blister.

16. The apparatus as claimed in claim 1, wherein the receptacle comprises the flexible strip of material, and the plurality of cavities are at least partly defined by the strip, further comprising a drive motor for moving the flexible strip to allow different cavities to be heated by the heating arrangement.

17. The apparatus as claimed in claim 16, wherein the drive motor comprises a rotatably mounted spool around which part of the flexible strip is wound.

18. The apparatus as claimed in claim 1, the apparatus comprising more than one of the receptacles, wherein the more than one receptacles are arranged in a stacked configuration in the housing.

19. The apparatus according to claim 1, wherein the aerosol generating material in one or more of the plurality of the cavities comprises a gel or a powder.

20. A receptacle configured to be inserted in a housing of an apparatus for heating an aerosol generating material to generate an inhalable aerosol and/or gas, the receptacle comprising a plurality of heater elements of a heating arrangements, the receptacle comprising:

a sheet or a flexible strip defining at least in part a plurality of cavities, each of the plurality of cavities containing an aerosol generating material, wherein when the sheet or the flexible strip is inserted in the housing each of the plurality of heater elements of the heating arrangement is arranged internally of a respective one of the plurality of cavities wherein each of the plurality of heater elements of the heating arrangement is configured for heating the aerosol generating material contained in a respective one of the plurality of cavities to generate an inhalable aerosol and/or gas.

21. The receptacle according to claim 20, further comprising a protective barrier on the receptacle sealing the aerosol generating material in the plurality of cavities.

22. The receptacle according to claim 21, wherein the protective barrier can be manipulated by a user to expose the aerosol generating material in one or more of the cavities, wherein the protective barrier can be one or more of ruptured by a user or removed from the receptacle by a user.

23. The receptacle according to claim 20, wherein the aerosol generating material in one or more of the plurality of the cavities comprises a gel or a powder.

* * * * *